US006789551B2

(12) United States Patent
Iosilevich

(10) Patent No.: US 6,789,551 B2
(45) Date of Patent: Sep. 14, 2004

(54) EYELASH SEPARATING, CURLING AND COLORING APPARATUS

(76) Inventor: Irina Iosilevich, 21005 Madria Cir., Boca Raton, FL (US) 33433

( * ) Notice: Subject to any disclaimer, the term of this patent is extended or adjusted under 35 U.S.C. 154(b) by 0 days.

(21) Appl. No.: 10/216,938

(22) Filed: Aug. 12, 2002

(65) Prior Publication Data

US 2002/0189628 A1 Dec. 19, 2002

Related U.S. Application Data

(63) Continuation-in-part of application No. 09/851,691, filed on May 8, 2001, now abandoned.

(51) Int. Cl.[7] ..... A45D 2/48; A45D 40/30
(52) U.S. Cl. ..... 132/217; 132/216
(58) Field of Search ..... 132/217, 216, 132/273, 279, 276

(56) References Cited

U.S. PATENT DOCUMENTS 2,133,042 A * 10/1938 Risberg ..... 132/217
2,323,595 A * 7/1943 Hanisch ..... 132/217
3,339,561 A * 9/1967 Brickner ..... 132/217
3,625,229 A * 12/1971 Silson ..... 132/217
5,307,826 A * 5/1994 Iosilevich ..... 132/218
6,105,585 A * 8/2000 Thomas ..... 132/217

* cited by examiner

*Primary Examiner*—John J. Wilson
*Assistant Examiner*—Robyn Kieu Doan
(74) *Attorney, Agent, or Firm*—Frank L. Kubler

(57) ABSTRACT

An eyelash curling and coloring apparatus includes an upper jaw structure having an upper jaw structure rearward end and an upper jaw structure forward end, the upper jaw structure forward end including an eyelash engaging flange projecting generally toward the lower jaw structure forward end for applying concentrated pressure to and progressively bending user eyelashes as the flange is slid axially along the eyelashes; a lower jaw structure having a lower jaw structure rearward end and a lower jaw structure forward end, the lower jaw structure forward end including coloring pad engaging structure; a coloring pad with eyelash coloring pigment material for securing to the lower jaw structure forward end with the coloring pad engaging structure; and a jaw hinge pivotally interconnecting the upper jaw structure rearward end and the lower jaw structure rearward end.

17 Claims, 3 Drawing Sheets

EYELASH SEPARATING, CURLING AND COLORING APPARATUS

FILING HISTORY

This application is a continuation-in-part of application Ser. No. 09/851,691, filed on May 8, 2001 now abandoned.

BACKGROUND OF THE INVENTION

1. Field of the Invention

The present invention relates generally to the field of cosmetics and cosmetic application. More specifically the present invention relates to an eyelash curling and coloring apparatus including an upper jaw structure and a lower jaw structure, the jaw structures each having jaw structure rearward ends which are pivotally interconnected by a jaw hinge, the lower jaw structure having a lower jaw structure forward end with coloring pad engaging means and the upper jaw structure having an upper jaw structure forward end with an eyelash engaging flange projecting generally toward the lower jaw structure forward end and having a rounded flange lower end. The coloring pad receives an eyelash coloring pigment and preferably includes a series of closely spaced grooves oriented perpendicular to the hinge pin and arrayed from one coloring pad lateral end to the other coloring pad lateral end, for aligning and separating the user eyelashes gripped between the jaw forward ends.

The hinge structure may include upper and lower lobes with registering hinge pin ports and a hinge pin passing through the hinge pin ports, or may include a flexible strip interconnecting and preferably integral with the upper and lower jaw structure rearward ends which resiliently bends to permit pivoting of the upper and lower jaw structures relative to each other. Stop projections preferably project from the middle region of upper jaw structure toward the lower jaw structure, and from the middle region of the lower jaw structure toward the upper jaw structure.

The coloring pad has a forward face which extends rearwardly as it extends upwardly and the engaging flange has a rearward face which extends forwardly as it extends downwardly. The individual coloring pad forward face and the engaging flange rearward face are have either a progressive curve or a planar bevel shape. As a result of this construction, during apparatus use, the engaging flange abuts the user eyelid to provide proper spacing so that the apparatus fully engages the eyelashes and yet does not pinch the user eyelid. As the engaging flange abuts the user eyelid, the user eyelashes rest on the engaging flange top face, and the engaging flange rearward face slides continuously along the coloring pad forward face as the upper and lower jaw structures are pivoted by user fingers to close together, pressing the eyelashes into the pad grooves, thereby laterally separating the eyelashes, pressing the eyelashes into coloring material on the pad, and the progressive sliding of the engaging flange along the upper surfaces of the eyelashes as the flange bears firmly against the eyelashes creates a progressive upward curl in the eyelashes.

2. Description of the Prior Art

There have long been eyelash coloring brushes and curling devices. A problem with these devices has been that none are believed to have been capable of both coloring and curling simultaneously. None have provided coloring pattern means.

Risberg, U.S. Pat. No. 2,133,042, issued on Oct. 11, 1938, teaches an eyelash curler with jaws which clamp against upper and lower sides of eyelashes. A problem with Risberg is that it is capable of straightening eyelashes, but not of significantly curling them. A problem with Rector is that the apparatus just stays in one place on the eyelashes and bends them into an L-shape, which is not a desired shape and is unhealthy. Thomas, U.S. Pat. No. 6,105,585, issued on Aug. 22, 2000, discloses a combination eyelash curler and eyeliner applicator, is a combination eyelash curler and eyeliner applicator, and not an eyelash coloring apparatus. Other related art includes Nist, U.S. Pat. No. 4,305,412, issued on Dec. 15, 1981, teaches an eyelash curler, with a blade for bending eyelashes, but which might also break or cut eyelashes; Stein, reveals an eyelash curler; Seidler, U.S. Pat. No. 3,516,423, issued on Jun. 23, 1970 discloses a cosmetic article applicator; Nojiri, U.S. Pat. No. 5,673,712, teaches an eyelash curler; Harris, U.S. Pat. No. 5,377,700, issued on Jan. 3, 1995, reveals an eyelash curler; and Rector, U.S. Pat. No. 2,392,694, issued on Jan. 8, 1946, discloses an eyelash crimper. None of the devices in the cited art provide eyelash separating grooves in eyelash contact surfaces, or provide progressive, sliding movement of a bearing surface along the length of the eyelashes to create a progressive, upward curl.

It is thus an object of the present invention to provide an eyelash curling and coloring apparatus which separates, colors and creates a progressive curl in the eyelashes simultaneously without breaking the eyelashes.

It is another object of the present invention to provide such an apparatus which is capable of depositing coloring material in pattern form on eyelashes, and permits replacing and washing of coloring delivery pads.

It is still another object of the present invention to provide such an apparatus which is compact, hygienic, easy to use, safe and durable.

Yet further objects of the present invention are to provide such an apparatus which does not pull eyelashes out by the roots and does not break eyelashes, which fits comfortably in the user hand and form fits along the curvature of user eyelids, which separates, lengthens and shapes and gently curls the entire length of the lashes in an natural-looking curl so that the eyelashes are thicker and more protected than ever with prior application devices.

It is finally an object of the present invention to provide such an apparatus which is inexpensive to manufacture.

SUMMARY OF THE INVENTION

The present invention accomplishes the above-stated objectives, as well as others, as may be determined by a fair reading and interpretation of the entire specification.

An eyelash curling and coloring apparatus is provided including an upper jaw structure having an upper jaw structure rearward end and an upper jaw structure forward end, the upper jaw structure forward end including an eyelash engaging flange projecting generally toward the lower jaw structure forward end for applying concentrated pressure to and progressively bending user eyelashes as the flange is slid axially along the eyelashes; a lower jaw structure having a lower jaw structure rearward end and a lower jaw structure forward end, the lower jaw structure forward end including coloring pad engaging structure; a coloring pad with eyelash coloring pigment material for securing to the lower jaw structure forward end with the coloring pad engaging structure; and a jaw hinge pivotally interconnecting the upper jaw structure rearward end and the lower jaw structure rearward end.

The coloring pad engaging structure preferably includes a forwardly opening mounting channel having a channel upper wall and a channel lower wall, and the channel lower wall projects forwardly beyond the channel upper wall to define a coloring pad mounting lip for receiving and supporting coloring pads; and the coloring pad has a pigment retaining body and a rearwardly protruding anchoring flange sized to fit snugly into the mounting channel, so that the pigment retaining body rests on the mounting lip. Each of the upper jaw structure forward end and the lower jaw structure forward end is preferably concavely curved rearwardly across its width to correspond to and receive the convex curvature of a typical user eyelid to permit gripping of eyelashes at their bases across the entire eyelash row; and the mounting channel and mounting lip and the coloring pad retaining body and anchoring flange are correspondingly curved.

The hinge structure preferably includes a pair of laterally spaced apart lower lobes protruding upwardly from the lower jaw structure rearward end, each lower lob having registering pin ports; pair of laterally spaced apart upper lobes protruding downwardly from the upper jaw structure rearward end having registering pin ports; and a hinge pin passing through the registering pin ports of the upper and lower lobes.

The eyelash curling and coloring apparatus preferably additionally includes a spring biasing mechanism extending between the upper jaw structure and lower jaw structure biasing the upper jaw structure forward end away from the lower jaw structure forward end. The spring biasing mechanism preferably includes an elongate leaf spring secured to the lower jaw structure with a fastener and extending rearwardly and passing rearwardly around the hinge pin and extending forwardly along the upper jaw structure to a point at which the leaf spring is secured with a fastener to the upper jaw structure.

The upper jaw structure has an upper jaw structure upper surface and the lower jaw structure has a lower jaw structure lower surface, and the apparatus preferably additionally includes finger grip assisting surface irregularities on the upper jaw structure upper surface and on the lower jaw structure lower surface.

BRIEF DESCRIPTION OF THE DRAWINGS

Various other objects, advantages, and features of the invention will become apparent to those skilled in the art from the following discussion taken in conjunction with the following drawings, in which.

DETAILED DESCRIPTION OF THE PREFERRED EMBODIMENTS

Figure 1:
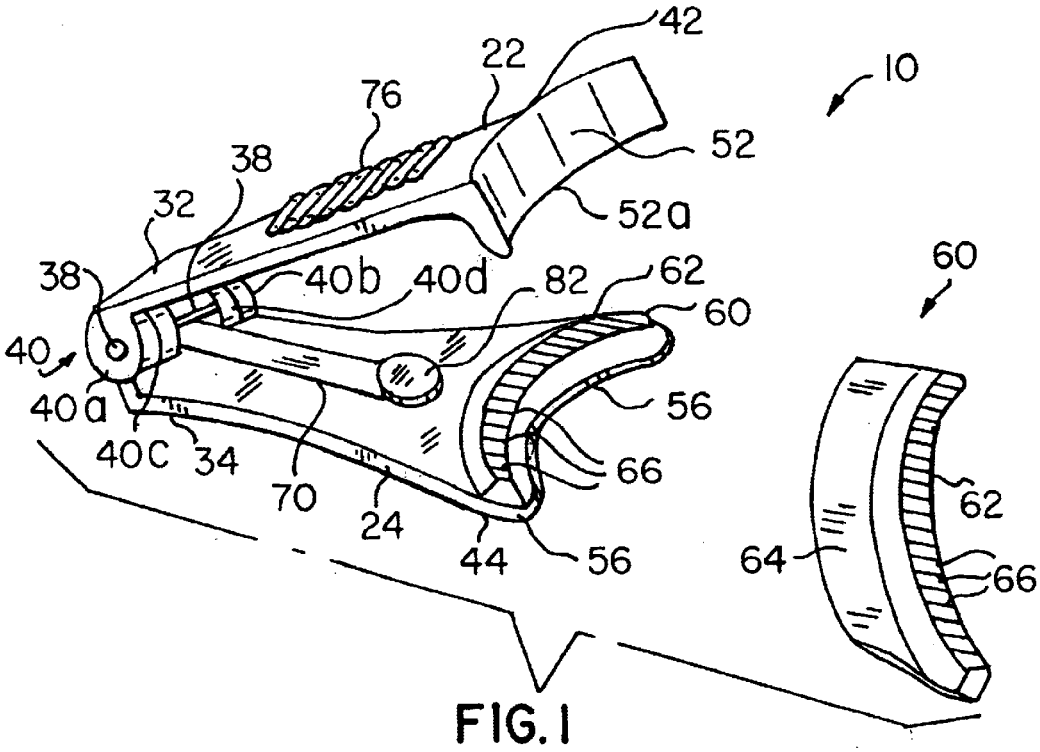
FIG. 1 is a perspective side view of the eyelash curling and coloring apparatus of the first embodiment in its open configuration, with a separate coloring pad positioned to the right of the apparatus for replacement of the coloring pad shown mounted to the apparatus.
Figure 2:
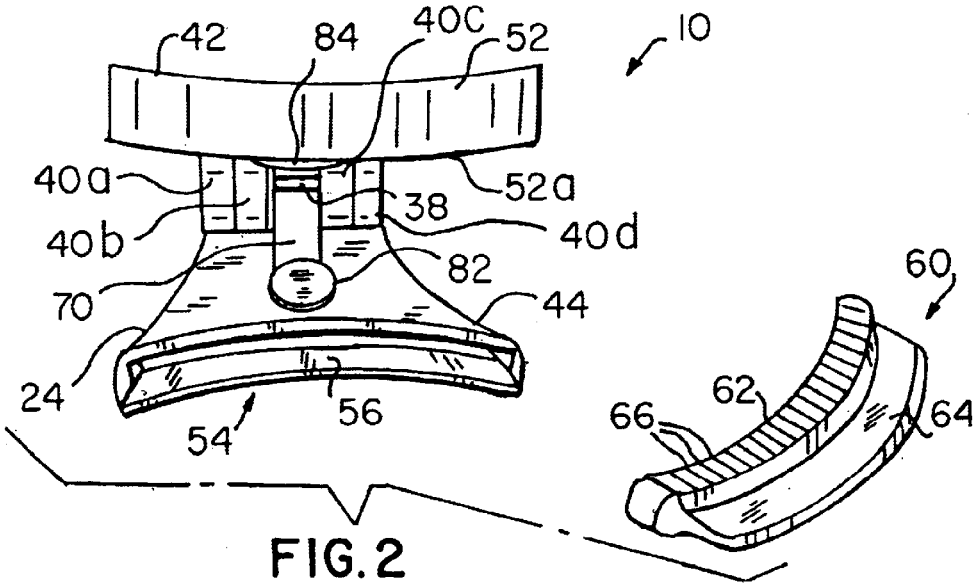
FIG. 2 is a perspective front view of the apparatus of FIG. 1, with the coloring pad removed and positioned forwardly of the apparatus to reveal the coloring pad mounting means.
Figure 3:
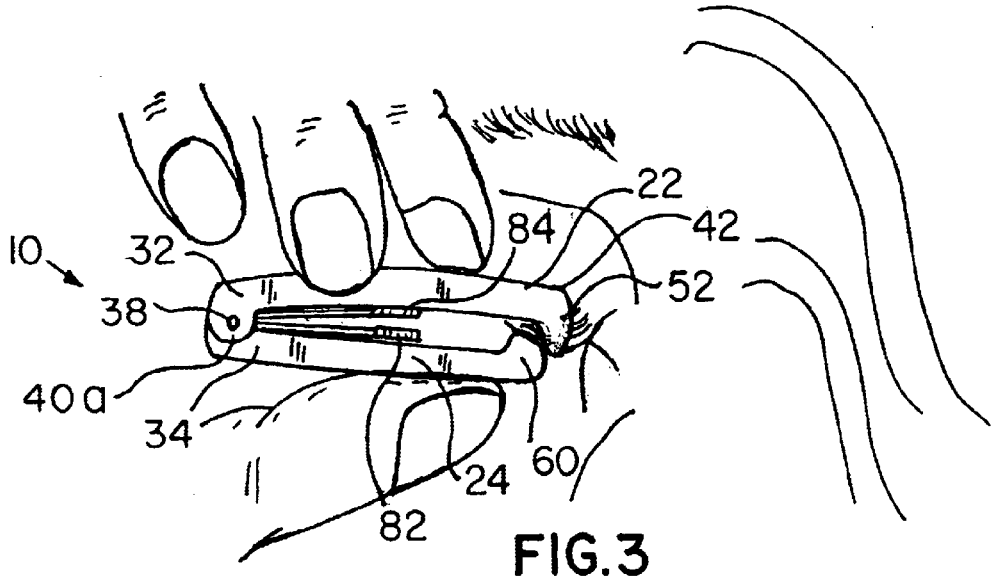
FIG. 3 is a side view of the apparatus of the first embodiment in its closed configuration, revealing how the apparatus engages and clamps user eyelashes.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Reference is now made to the drawings, wherein like characteristics and features of the present invention shown in the various FIGURES are designated by the same reference numerals.

First Preferred Embodiment

Referring to FIGS. 1–3 and 6, an eyelash curling and coloring apparatus 10 is disclosed, including an upper jaw structure 22 and a lower jaw structure 24, the jaw structures each having jaw structure rearward ends 32 and 34 which are pivotally interconnected by a jaw hinge structure 40, the lower jaw structure 24 having a lower jaw structure forward end 44 with coloring pad engaging means 56 and the upper jaw structure 22 having an upper jaw structure forward end 42 with an eyelash engaging flange 52 projecting generally toward the lower jaw structure forward end 44. Engaging flange 52 preferably has a rounded lower edge 52*a* for applying concentrated pressure to and progressively bending eyelashes as the flange 52 is manually slid axially along the eyelashes. Coloring pad engaging means 46 preferably includes a forwardly opening mounting channel 54, the lower wall of mounting channel 54 projecting forwardly beyond the mounting channel upper wall to define a mounting lip 56, for receiving coloring pads 60. The coloring pads 60 each have a pigment retaining body 62 and a rearwardly protruding mounting lip 64 sized to fit snugly into the mounting channel 54, so that the pigment retaining body 62 rests on the mounting lip 64. Coloring pads 60 are also provided having the same configuration as described above but without pigment material and with eye make-up remover in its place, for mounting in the apparatus as described and for sliding longitudinally along the user eyelashes to remove pigment material from the eyelashes. The apparatus 10 can also be used to grip, maneuver and apply false eyelashes to the user eyelids and to remove mascara as well.

The upper and lower jaw structure forward ends 42 and 44 preferably are each concavely and matchingly curved rearwardly across their width to correspond to and receive the convex curvature of a typical user eyelid to permit gripping of eyelashes at their bases across the entire eyelash row. The mounting channel 54 and mounting lip 64 of the lower jaw structure 24, and the pigment retaining body 62 and mounting lip 64 are all correspondingly curved. Jaw hinge structure 40 preferably includes a pair of laterally spaced apart lower lobes 40*a* and 40*b* protruding upwardly from the lower jaw structure rearward end 34 having registering pin ports 40*c,* and a pair of laterally spaced apart upper lobes 40*c* and 40*d* protruding downwardly from the upper jaw structure rearward end having registering pin ports, and a hinge pin passing through the mutually aligned pin ports of the upper and lower lobes 40*a*–40*d.* Spring biasing means are preferably provided to bias the jaw structure forward ends 42 and 44 away from each other to hold the apparatus 10 in an open configuration. The spring biasing means preferably takes the form of an elongate leaf spring 70 is preferably secured to the lower jaw structure 24 upper surface, with a rivet 82 and extends rearwardly to pass rearwardly around the hinge pin 38 and extends forwardly to along the upper jaw structure 22 lower surface to a point at which the leaf spring 70 is secured with a rivet 84 to the upper jaw structure 22 lower surface. Finger grip assisting surface irregularities 76 are preferably provided on the upper jaw structure upper surface and on the lower jaw structure lower surface.

For all embodiments, the coloring pad 60 preferably includes a series of closely spaced grooves 66 oriented parallel to the apparatus 10 and arrayed from one coloring pad lateral end 60*a* to the other coloring pad lateral end 60*b,* for aligning and separating user eyelashes gripped between the jaw forward ends 42 and 44.

The eyelash engaging flange 52 has a flange lower edge 52*a* which is rounded so that it does not break eyelashes. Coloring pad 60 has a forward face 60*a* which extends forwardly as it extends downwardly, and engaging flange 52 has a rearward face 52*b* which extends rearwardly as it extends upwardly. The individual coloring pad forward face 60*a,* and engaging flange rearward face 52*b,* preferably follow either a progressive curve or a planar bevel shape. As a result of this construction, during apparatus 10 use, engaging flange 52 abuts a user eyelid to provide proper spacing so that apparatus 10 fully engages user eyelashes and yet does not pinch the user eyelid. As engaging flange 52 abuts the user eyelid, the user eyelashes rest on the coloring pad top face 60*b,* and the engaging flange rearward face slides 52*b* continuously along coloring pad forward face 60*a* as the upper and lower jaw structures 22 and 24, respectively, are pivoted toward each other and to close together, pressing the eyelashes into the pad grooves 66, thereby laterally separating the eyelashes, and pressing the eyelashes into coloring material on the pad 60, and the progressive sliding of engaging flange 52 along the upper surfaces of the user eyelashes as the flange 52 bears firmly against the eyelashes creates a progressive upward curl in the eyelashes.

Method

In practicing the invention, the following method may be used. To use apparatus 10, an eyelash coloring pad 60 is fitted into the pad engaging means 46. Then conventional eyelash coloring material/pigment, which is commonly available in stores today, is applied to the coloring pad 60. The coloring pads 60 are preferably absorbent and may be impregnated with a single pigment or with an array of two or more pigments in discrete segments defining a pattern for coloring the eyelashes with a series of color stripes to create a rainbow impression. Then the apparatus is positioned so that upper jaw structure 22 is located above the row of user eyelashes and immediately adjacent to, and optionally touching, the user eyelid, and the lower jaw structure 24 is located below the row of user eyelashes. Then the upper and lower jaw structure forward ends 42 and 44 are squeezed together by user fingers against the biasing of the spring 70 and into tight gripping contact with the eyelashes such that the flange 64 presses the eyelashes against the coloring pad 60. Then apparatus 10 is pulled away from the eyelid, along the lengths of the eyelashes and off the ends of the eyelashes. This action impresses a progressive upward bend into the eyelashes and simultaneously applies pigment from the coloring pad 60. Once the pigment is depleted or a different color or color pattern is desired, the pad 60 is removed and replaced with a fresh pad 60 having the desired color or color pattern.

Second Preferred Embodiment

Figure 4:
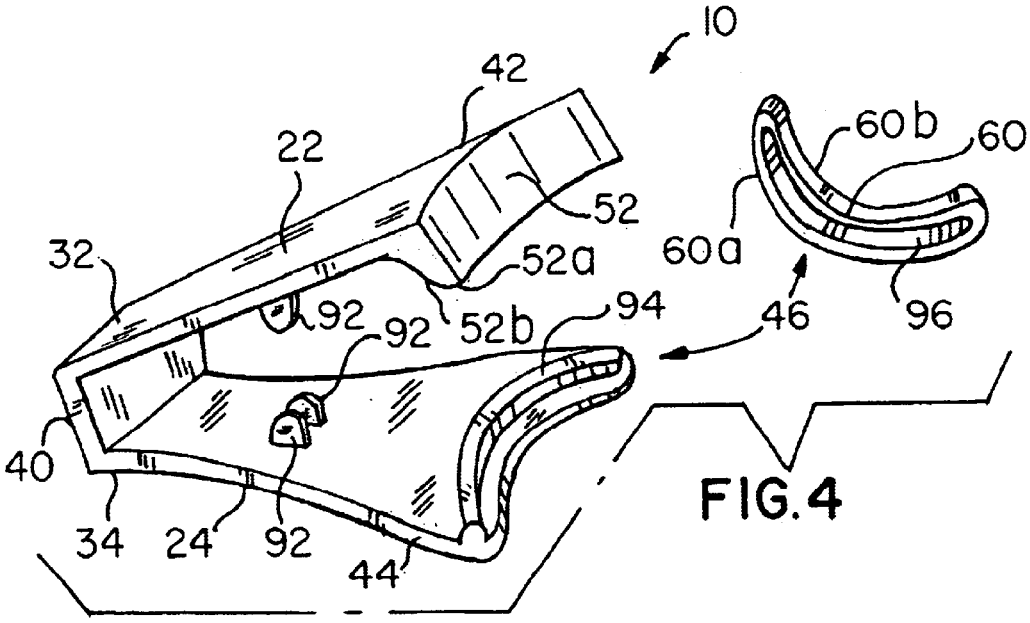
FIG. 4 is a perspective side view of the eyelash curling and coloring apparatus of the second embodiment in its open configuration, once again with a separate coloring pad positioned to the right of the apparatus for replacement of the coloring pad shown mounted to the apparatus.
Figure 5:
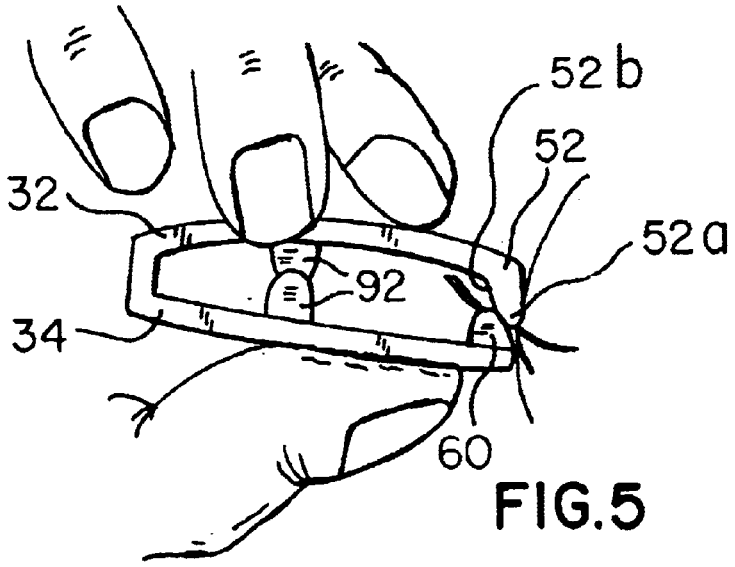
FIG. 5 is a side view of the apparatus of the second embodiment in its closed configuration, revealing how the apparatus engages and clamps user eyelashes.
Figure 6:
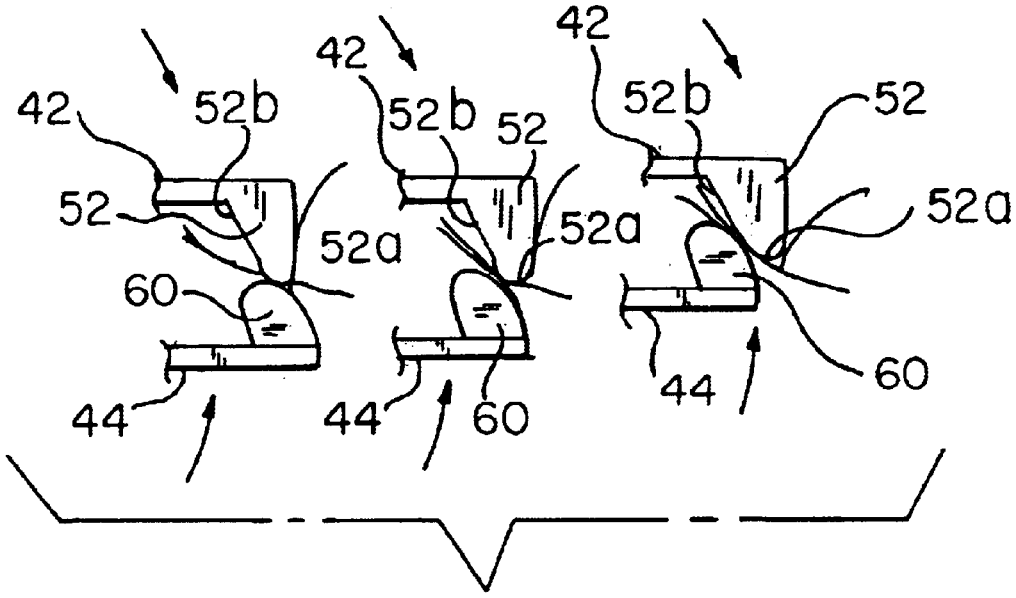
FIG. 6 is a series of forward segments of the upper and lower jaw structures for either the first embodiment or the second embodiment, shown progressively closing onto and curling user eyelashes, showing how the continuous sliding of the flange rearward face against the pad forward face and in turn a progressive sliding of the flange along the lengths of the user eyelashes, creating a progressive upward curl rather than the sharp bend produced by much of the prior art devices.

Referring to FIGS. 4–6, hinge structure 40 includes a flexible strip 46 interconnecting and preferably integral with the upper and lower jaw structure rearward ends 32 and 34 respectively which bends to permit pivoting of the upper and lower jaw structures to each other and resiliently returns to its original shape, which upper and lower jaw structure forward ends 42 and 44 are spaced apart and apparatus 10 is open. Stop projections 92 preferably project from the middle region of upper jaw structure 22 toward the lower jaw structure 24, and from the middle region of the lower jaw structure 24 toward the upper jaw structure 22, so that stop projections 92 contact and abut the opposing jaw structure 22 or 24 at the point at which apparatus 10 is fully closed, to prevent upper and lower jaw structures 22 and 24 from bowing inwardly and thus deforming under pressure from user fingers. Upper and lower jaw stop projections 92 preferably pass closely adjacent to each other, and may slide against each other, to prevent lateral movement of upper jaw structure 22 relative to lower jaw structure 24 during apparatus 10 closing. See FIGS. 4 and 5.

As recited for the first embodiment, the eyelash engaging flange 52 has a flange lower edge 52*a* which is rounded so that it does not break eyelashes. Once again, coloring pad 60 has a forward face 60*a* which extends forwardly as it extends downwardly, and engaging flange 52 has a rearward face 52*b* which extends rearwardly as it extends upwardly. The individual coloring pad forward face 60*a,* and engaging flange rearward face 52*b,* preferably follow either a progressive curve or a planar bevel shape. As a result of this construction, during apparatus 10 use, engaging flange 52 abuts a user eyelid to provide proper spacing so that apparatus 10 fully engages user eyelashes and yet does not pinch the user eyelid. As engaging flange 52 abuts the user eyelid, the user eyelashes rest on the coloring pad top face 60*b,* and the engaging flange rearward face slides 52*b* continuously along coloring pad forward face 60*a* as the upper and lower jaw structures 22 and 24, respectively, are pivoted toward each other and to close together, pressing the eyelashes into the pad grooves 66, thereby laterally separating the eyelashes, and pressing the eyelashes into coloring material on the pad 60, and the progressive sliding of engaging flange 52 along the upper surfaces of the user eyelashes as the flange 52 bears firmly against the eyelashes creates a progressive upward curl in the eyelashes. See FIGS. 2 and 6. For the second embodiment, the coloring pad 60 engaging means includes an upwardly projecting pad mounting flange 94 over which a coloring pad 60 having a downwardly opening mounting flange receiving channel 96 fits, and which may be secured over mounting flange 94 with an adhesive.

While the invention has been described, disclosed, illustrated and shown in various terms or certain embodiments or modifications which it has assumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim as my invention:

1. An eyelash curling and coloring apparatus, comprising:

a lower jaw structure having a lower jaw structure rearward end and a lower jaw structure forward end, said lower jaw structure forward end comprising coloring pad engaging means;

an upper jaw structure having an upper jaw structure rearward end and an upper jaw structure forward end, said upper jaw structure forward end comprising an eyelash engaging flange projecting generally toward the lower jaw structure forward end for applying concentrated pressure to and progressively bending user eyelashes as said flange is slid axially along the eyelashes, said engaging flange having a flange top face;

a coloring pad with eyelash coloring pigment material for securing to said lower jaw structure forward end with said coloring pad engaging means, wherein said coloring pad has a coloring pad forward face which is downwardly angled to extend rearwardly as it extends upwardly and wherein said engaging flange has an engaging flange rearward face which is upwardly angled to extend forwardly as it extends downwardly;

and jaw hinge means pivotally interconnecting said upper jaw structure rearward end and said lower jaw structure rearward end;

such that, during apparatus use, as said engaging flange abuts the user eyelid, the apparatus fully engages the base of the eyelashes and yet does not pinch the user eyelid, and such that, as said engaging flange abuts the user eyelid, said user eyelashes rest on said engaging flange top face, and said engaging flange rearward face slides continuously along said coloring pad forward face as said upper and lower jaw structures are pivoted to close together, and the progressive sliding of said engaging flange along eyelash upper surfaces as the flange bears firmly against the eyelashes creates a progressive upward curl in the eyelashes.

2. The eyelash curling and coloring apparatus of claim 1, wherein said hinge structure comprises:

a pair of laterally spaced apart lower lobes protruding upwardly from said lower jaw structure rearward end, each said lower lobes having registering pin ports;

a pair of laterally spaced apart upper lobes protruding downwardly from said upper jaw structure rearward end having registering pin ports;

and a hinge pin passing through said registering pin ports of said upper and lower lobes.

3. The eyelash curling and coloring apparatus of claim 2, additionally comprising:

spring biasing means extending between said upper jaw structure and lower jaw structure biasing said upper jaw structure forward end away from said lower jaw structure forward end.

4. The eyelash curling and coloring apparatus of claim 3, wherein said spring biasing means comprises an elongate leaf spring secured to said lower jaw structure with a fastener and extending rearwardly and passing rearwardly around said hinge pin and extending forwardly along said upper jaw structure to a point at which said leaf spring is secured with a fastener to said upper jaw structure.

5. The eyelash curling and coloring apparatus of claim 1, wherein said upper jaw structure has an upper jaw structure upper surface and said lower jaw structure has a lower jaw structure lower surface, said apparatus additionally comprising finger grip assisting surface irregularities on said upper jaw structure upper surface and on said lower jaw structure lower surface.

6. The eyelash curling and coloring apparatus of claim 1, wherein said hinge structure comprises:

a flexible strip interconnecting said upper jaw structure rearward end and said lower jaw structure rearward end, for bending to permit pivoting of said upper and lower jaw structures relative to each other.

7. The eyelash curling and coloring apparatus of claim 1, wherein said eyelash engaging flange has an engaging flange lower edge and wherein said engaging flange lower edge is rounded to prevent eyelash breakage.

8. An eyelash curling and coloring apparatus, comprising:

an upper jaw structure having an upper jaw structure rearward end and an upper jaw structure forward end, said upper jaw structure forward end comprising an eyelash engaging flange projecting generally toward the lower jaw structure forward end for applying concentrated pressure to and progressively bending user eyelashes as said flange is slid axially along the eyelashes;

a lower jaw structure having a lower jaw structure rearward end and a lower jaw structure forward end, said lower jaw structure forward end comprising coloring pad engaging means;

a coloring pad with eyelash coloring pigment material for securing to said lower jaw structure forward end with said coloring pad engaging means;

and jaw hinge means pivotally interconnecting said upper jaw structure rearward end and said lower jaw structure rearward end;

wherein said coloring pad engaging means comprises a forwardly opening mounting channel having a channel upper wall and a channel lower wall, wherein said channel lower wall projects forwardly beyond said channel upper wall to define a coloring pad mounting lip for receiving and supporting coloring pads;

and wherein said coloring pad has a pigment retaining body and a rearwardly protruding anchoring flange sized to fit snugly into said mounting channel, such that the pigment retaining body rests on said mounting lip.

9. The eyelash curling and coloring apparatus of claim 8, wherein each of said upper jaw structure forward end and said lower jaw structure forward end is concavely curved rearwardly across its width to correspond to and receive the convex curvature of a typical user eyelid to permit gripping of eyelashes at their bases across the entire eyelash row;

and wherein said mounting channel and mounting lip and said coloring pad retaining body and anchoring flange are correspondingly curved.

10. An eyelash curling and coloring apparatus, comprising:

an upper jaw structure having an upper jaw structure rearward end and an upper jaw structure forward end, said upper jaw structure forward end comprising an eyelash engaging flange projecting generally toward the lower jaw structure forward end for applying concentrated pressure to and progressively bending user eyelashes as said flange is slid axially along the eyelashes;

a lower jaw structure having a lower jaw structure rearward end and a lower jaw structure forward end, said lower jaw structure forward end comprising coloring pad engaging means;

a coloring pad with eyelash coloring pigment material for securing to said lower jaw structure forward end with said coloring pad engaging means;

and jaw hinge means pivotally interconnecting said upper jaw structure rearward end and said lower jaw structure rearward end;

wherein said coloring pad engaging means comprises a downwardly opening flange receiving channel in said coloring pad and an upwardly projecting pad mounting flange at said lower jaw forward end over which said flange receiving channel fits.

11. An eyelash curling and coloring apparatus, comprising:

an upper jaw structure having an upper jaw structure rearward end and an upper jaw structure forward end, said upper jaw structure forward end comprising an eyelash engaging flange projecting generally toward the lower jaw structure forward end for applying concentrated pressure to and progressively bending user eyelashes as said flange is slid axially along the eyelashes;

a lower jaw structure having a lower jaw structure rearward end and a lower jaw structure forward end, said lower jaw structure forward end comprising coloring pad engaging means;

a coloring pad with eyelash coloring pigment material for securing to said lower jaw structure forward end with said coloring pad engaging means, said coloring pad comprising two opposing coloring pad lateral ends and a coloring pad top face, and a series of grooves in said coloring pad top face oriented substantially parallel to the apparatus longitudinal axis and arrayed substantially from one said coloring pad lateral end to the other said coloring pad lateral end, for separating user eyelashes gripped between said upper and lower jaw forward ends;

and jaw hinge means pivotally interconnecting said upper jaw structure rearward end and said lower jaw structure rearward end.

12. The eyelash curling and coloring apparatus of claim 11, wherein said hinge structure comprises a flexible strip interconnecting said upper jaw structure rearward end and said lower jaw structure rearward end, for bending to permit pivoting of said upper and lower jaw structures relative to each other.

13. The eyelash curling and coloring apparatus of claim 11, wherein said upper and lower jaw structures each have a jaw middle region, said apparatus additionally comprising:

a stop projection projecting from at least one said jaw middle region toward the other said jaw middle region, such that said stop projection contacts and abuts the other said jaw middle region when said upper and lower jaw structures are closed together, to prevent said upper and lower jaw structures from bowing toward each other under pressure from user fingers.

14. The eyelash curling and coloring apparatus of claim 11, wherein said eyelash engaging flange has an engaging flange lower edge and wherein said engaging flange lower edge is rounded to prevent eyelash breakage.

15. The eyelash curling and coloring apparatus of claims 11, wherein said coloring pad engaging means comprises a downwardly opening flange receiving channel in said coloring pad and an upwardly projecting pad mounting flange at said lower jaw forward end over which said flange receiving channel fits.

16. An eyelash curling and coloring apparatus, comprising:

a lower jaw structure having a lower jaw structure rearward end and a lower jaw structure forward end, said lower jaw structure forward end comprising coloring and engaging means;

an upper jaw structure having an upper jaw structure rearward end and an upper jaw structure forward end, said upper jaw structure forward end comprising an eyelash engaging flange projecting generally toward the lower jaw structure forward end for applying concentrated pressure to and progressively bending user eyelashes as said flange is slid axially along the eyelashes, said engaging flange having a flange top face;

a coloring pad with eyelash coloring pigment material for securing to said lower jaw structure forward end with said coloring pad engaging means, wherein said coloring pad has a coloring pad forward face which is downwardly angled to extend rearwardly as it extends upwardly and wherein said engaging flange has an engaging flange rearward face which is upwardly angled to extend forwardly as it extends downwardly;

and jaw hinge means pivotally interconnecting said upper jaw structure rearward end and said lower jaw structure rearward end;

such that, during apparatus use, as said engaging flange abuts the user eyelid, the apparatus fully engages the base of the eyelashes and yet does not pinch the user eyelid, and such that, as said engaging flange abuts the user eyelid, said user eyelashes rest on said engaging flange top face, and said engaging flange rearward face slides continuously alone said coloring pad forward face as said upper and lower jaw structures are pivoted to close together, and the progressive sliding of said engaging flange along eyelash upper surfaces as the flange bears firmly against the eyelashes creates a progressive upward curl in the eyelashes;

wherein said coloring pad engaging means comprises a downwardly opening flange receiving channel in said coloring pad and an upwardly projecting pad mounting flange at said lower jaw forward end over which said flange receiving channel fits.

17. The eyelash curling and coloring apparatus of claim 16, wherein said coloring pad forward face and said engaging flange rearward face have one of: a curved cross-section and a planar bevel cross-section.

* * * * *